US009074586B2

(12) United States Patent
Dueckinghaus et al.

(10) Patent No.: US 9,074,586 B2
(45) Date of Patent: Jul. 7, 2015

(54) HYDROSTATIC MACHINE

(75) Inventors: Heinrich Dueckinghaus, Bielefeld (DE); Burkhard Seibel, Bielefeld (DE); Sven Bauer, Schemmerhofen (DE)

(73) Assignee: CLAAS Selbstfahrende Erntemaschinen GmbH, Harsewinkel (DE)

( * ) Notice: Subject to any disclaimer, the term of this patent is extended or adjusted under 35 U.S.C. 154(b) by 759 days.

(21) Appl. No.: 13/115,312

(22) Filed: May 25, 2011

(65) Prior Publication Data

US 2011/0315006 A1 Dec. 29, 2011

(30) Foreign Application Priority Data

May 27, 2010 (DE) ..... 10 2010 021 708

(51) Int. Cl.

| | |
|---|---|
| ***F03C 1/06*** | (2006.01) |
| ***F04B 1/22*** | (2006.01) |
| ***F03C 1/40*** | (2006.01) |
| ***F04B 1/32*** | (2006.01) |

(52) U.S. Cl.

CPC ..... *F04B 1/22* (2013.01); *F03C 1/0639* (2013.01); *F03C 1/0686* (2013.01); *F04B 1/324* (2013.01)

(58) Field of Classification Search

CPC ..... F03C 1/005; F03C 1/0686; F03C 1/0639; F04B 1/295; F04B 1/22; F04B 1/324

USPC ..... 92/13, 17; 60/492

See application file for complete search history.

(56) References Cited

U.S. PATENT DOCUMENTS

| | | | | |
|---|---|---|---|---|
| 2,957,462 | A * | 10/1960 | Clark | 123/51 B |
| 5,531,072 | A * | 7/1996 | Larkin | 60/492 |
| 8,235,681 | B2 * | 8/2012 | Shimizu | 417/269 |
| 2005/0123412 | A1 * | 6/2005 | Shimizu | 417/269 |
| 2005/0238501 | A1 * | 10/2005 | Brailovskiy | 417/222.1 |
| 2007/0081904 | A1 * | 4/2007 | Kurita et al. | 417/269 |
| 2008/0190398 | A1 * | 8/2008 | Geirnaert | 123/51 R |
| 2009/0095150 | A1 * | 4/2009 | Bergmann | 92/13 |
| 2010/0083822 | A1 * | 4/2010 | Shimizu | 91/505 |

FOREIGN PATENT DOCUMENTS

DE 10 2007 022 022 11/2008

* cited by examiner

*Primary Examiner* — Nathaniel Wiehe
*Assistant Examiner* — Abiy Teka
(74) *Attorney, Agent, or Firm* — Michael J. Striker

(57) ABSTRACT

A hydrostatic machine, has first and second axial-piston units arranged on a common axis and having pistons which cooperate with an adjustable swash plates, wherein the first axial-piston unit has a first one of the swash plates associated with it while the second axial-piston unit has a second one of the swash plates associated with it, and a coupling mechanism which couples the first and the second swash plates mechanically and adjustably.

13 Claims, 3 Drawing Sheets

HYDROSTATIC MACHINE

CROSS-REFERENCE TO RELATED APPLICATION

The invention described and claimed hereinbelow is also described in German Patent Application DE 10 2010 021 708.5 filed on May 27, 2010. This German Patent Application, whose subject matter is incorporated here by reference, provides the basis for a claim of priority of invention under 35 U.S.C. 119(a)-(d).

BACKGROUND OF THE INVENTION

The present invention relates to a hydrostatic machine having two axial-piston units arranged on a common axis. A machine of this kind is known from DE 10 2007 022 022 A1.

In this known machine, the two axial-piston units co-operate with oppositely positioned surfaces of one and the same swash plate. The axial forces which are exerted on the swash plate by the cylinders of the axial-piston units largely compensate for one another in this way. This reduces the requirements which the mounting of the swash plate has to meet with regard to load-bearing capacity and enables the machine to be produced in a compact and light-weight form.

SUMMARY OF THE INVENTION

It is an object of the present invention to continue the development of this known machine in order to widen its field of application, e.g. as a hydraulic pump or hydraulic motor.

The object is achieved by virtue of the fact that, in a hydrostatic machine having a first second axial-piston unit which are arranged on a common axis and which have pistons which co-operate with an adjustable swash plate, the first axial-piston unit has a first swash plate associated with it and the second axial-piston unit has a second swash plate associated with it, the first and the second swash plate being adjustable in unison parallel to one another by a coupling mechanism.

The replacement of the conventional single swash plate by two coupled swash plates enables the practical properties of the hydrostatic machine to be improved in two respects. On the one hand, the division into two enables the two swash plates to be so arranged as to be pivotable on two different axes; in particular, the axes of pivot may be so positioned that the distance between the swash plates, as measured in the direction defined by the common axis of the axial-piston units, is all the greater the less inclined is the position of the swash plates. Such an increase in the distance results in the mean volume of the cylinders of the axial-piston units, and hence too the deleterious volume, becoming all the smaller as the inclined position becomes less pronounced. Hence low-loss operation is possible particularly at a not very inclined position.

To allow a change of this kind in the distance between the swash plates to be achieved in practice, it is possible, when an imaginary plane extending along the common axis of the axial-piston units divides at least the first swash plate into a half adjacent the first axial-piston unit and a half remote from the first axial-piston unit, for the axis of pivot of the first swash plate to be usefully situated on the same side of this plane as that half of the first swash plate which is adjacent the first axial-piston unit.

It is also useful for the axis of pivot of the first swash plate to extend across a surface of the first swash plate which faces the first axial-piston unit.

If the longitudinal axis of a cylinder of the axial-piston unit which is situated at its top dead centre also intersects the axis of pivot of the first swash plate, the position of the dead centre of the cylinder is not dependent on the pivoted position of the swash plate. The deleterious volume of the cylinder can thus be made independent of its pivoted position; in particular it may be made equal to virtually zero for any pivoted position.

The two axial-piston units should be connected together in such a way as to be solid in rotation with one another. This ensures that pressures exerted by the two axial-piston units on their associated swash plates in the axial direction are equal and opposite and are able to compensate for one another at a common mounting for the two swash plates.

It may also help to relieve the load on such a mounting if the coupling mechanism comprises a support which extends between the first and the second swash plate and which is arranged to pass on pressure exerted by one of the axial-piston units on its associated swash plate to the other swash plate, A simple and effective coupling mechanism may comprise a guiding track solid with one of the swash plates and a stop which is solid with whichever is the other swash plate in the given case and which is able to move along the guiding track. A carrier of the guiding track may, at the same time, act as the above-mentioned support.

Alternatively, gearing may equally well be provided as a coupling mechanism.

If the hydrostatic machine is intended to operate primarily as a pump, then the two swash plates are preferably pivotable between positive and negative angles of pivot, about a zero position which is perpendicular to the axis of rotation of the machine.

In the case of a hydrostatic machine which is designed primarily for operation as a motor, it is enough for the swash plates to be pivotable on only one side of the zero position, e.g. each from the zero position to a maximum positive angle of pivot.

In a refinement of the invention which is a particular preference, one of the swash plates has a greater freedom of pivoting movement than the other swash plate, and the freedom of pivoting movement only of the one swash plate includes a zero position.

This affords the possibility not only of both axial-piston units being operated with indrawn volumes which are each the same but also of one being operated with an indrawn volume of zero and the other with a small, but not vanishingly so, indrawn volume. This makes the technically usable spread over which the hydrostatic machine can be operated as a motor twice as wide as that of the axial-piston units by which it is formed if each is considered on its own.

A partial decoupling of this kind of the swash plates, with a transition to the zero position, can easily be accomplished in the case of the above-mentioned coupling mechanism having a guiding track and a stop able to move along the guiding track by giving the guiding track an arcuate portion which is centred on the axis of pivot of the other swash plate.

Other features and advantages of the invention can be seen from the following description of embodiments, which is given by reference to the accompanying drawings.

DESCRIPTION OF THE PREFERRED EMBODIMENTS

Figure 1:
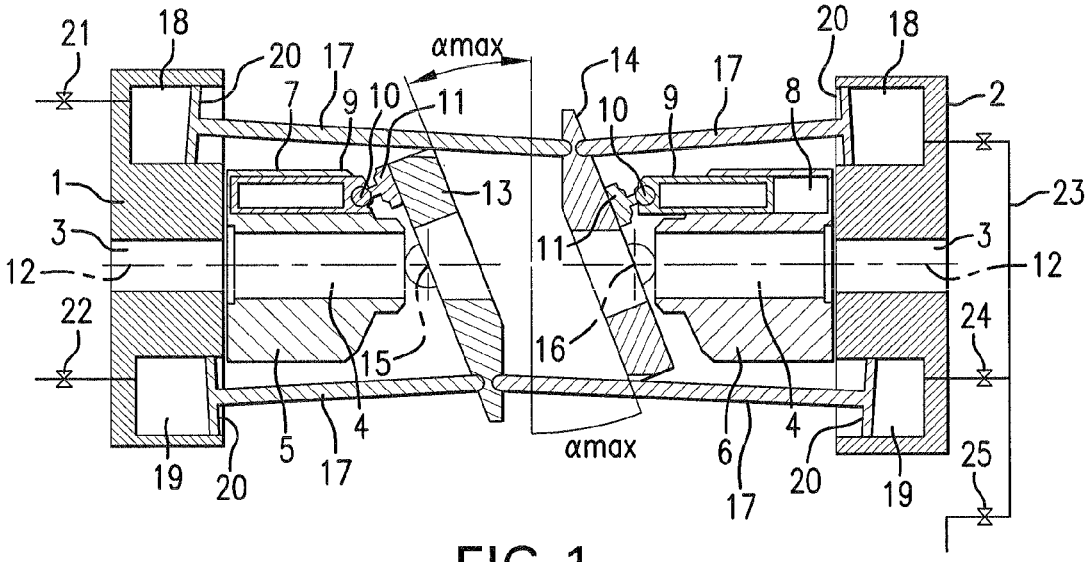
FIG. 1 is an axial schematic section through a first embodiment of hydrostatic machine according to the invention.

The hydrostatic machine which is shown in a schematic section in FIG. 1 has a cylindrical housing whose end-walls are indicated as 1 and 2 in the drawing. A cylindrical outer shell which connects the end-walls 1, 2 is not shown in the drawing. A shaft, which is also not shown in the drawing for the sake of clarity, extends through central bores 3 in the end-walls 1, 2 and is connected to the axial-piston units 5, 6 to be solid in rotation therewith. In the following description, the housing will be assumed to be fixed in position and the axial-piston units 5, 6 to be rotatable but it goes without saying that the reverse would also be possible. The axial-piston units 5, 6 in turn each have a central bore 4 through which the shaft extends, and respective cylinder bores 7, 8 which are arranged in a circle around the central bores 4 and of which one can be seen in section in each case and in which respective pistons 9 are guided to be movable axially. Jointed, by a ball-joint 10 in each case, to each of the free ends of the pistons 9 which project from the cylinder bores 7, 8 is a sliding shoe 11 which presses against a swash plate 13 or 14, which swash plate 13 or 14 is aligned at an inclination to the longitudinal axis 12 of the machine.

The swash plates 13, 14 are able to pivot on axes of pivot 15, 16 which are orientated perpendicularly to the plane of section of FIG. 1, and their pivoted position is controlled with the help of rods 17 which engage with respective opposite edges of the swash plates 13, 14 and which in turn are connected to pistons 20 which are displaceable in cylinders 18, 19 in the end-walls 1, 2. FIG. 1 shows the swash plates 13, 14 in a maximum inclined position where they are deflected at an angle $\alpha_{max}$, of for example 21° each, from a position perpendicular to the longitudinal axis 12 which will also be referred to as the zero position in what follows.

In the embodiment shown in FIG. 1, the cylinders 18, 19 in the end-wall 1 can each be connected via respective shut-off valves 21, 22 to a source or sink for hydraulic fluid, whereas the cylinders 18, 19 in the end-wall 2 situated opposite are able to communicate with one another via a line 23. If for example hydraulic fluid is admitted into the cylinder 18 in the end-wall 1 via the shut-off valve 21, the piston 20 in this cylinder thrusts the swash plate 14 to a less inclined position. At the same time, the piston 20 in the cylinder 18 in the end-wall 2 is slid back and hydraulic fluid is transferred via the line 23 into the cylinder 19 in the end-wall 2, and the piston 20 in this cylinder drives a pivoting movement of the swash plate 13, and the two swash plates 13, 14 thus maintain their parallel orientation.

In the case of a hydrostatic machine for operation as a pump, the freedom of pivoting movement of the two mash plates 13, 14 may extend over an angular interval [$-\alpha_{max}$, $\alpha_{max}$] on the two sides of the zero position.

In the case of a hydrostatic machine for operation as a motor, an angular interval of pivoting movement through which the two swash plates 13, 14 pivot in parallel with one another extends between $\alpha_{max}$ and a small positive bottom limiting value $\alpha_{min}$ of for example 7°. If the angle of pivot of the two swash plates 13, 14 reaches this bottom limiting value $\alpha_{min}$, a shut-off valve 24 in the line 23 is closed, and a shut-off valve 25 is opened to connect the line 23 to a tank holding hydraulic fluid. The closing of the shut-off valve 24 immobilises the pistons in the two cylinders 19 and the swash plate 13 is unable to pivot past the angle $\alpha_{min}$ to smaller angles of pivot, whereas the swash plate 14, if the infeed of hydraulic fluid through the shut-off valve 21 continues, can reach the zero position in which it is orientated at right angles to the axis 12 and in which the volume of the cylinder bores 8 does not vary in the course of a revolution of the axial-piston units 5, 6.

The reason for the differing adjustability of the two swash plates 13, 14 is the self-locking effect which occurs when an axial-piston unit is operating as a motor if the angle of pivot of its swash plate goes below a minimum: there is a sharp rise in the frictional forces as the angle of pivot goes down and the minimum angle of pivot is the angle at which they reach 100%. Although operation would be possible just above this minimum angle of pivot, it would not be very economical due to the high losses. Because one swash plate can be pivoted to the zero position in the machine according to the invention while the other remains at the angle of pivot $\alpha_{min}$ at which losses are still low, operation with appreciably lower losses is possible than if both axial-piston units were to operate at an angle of pivot of $\alpha_{min}/2$.

Figure 2:
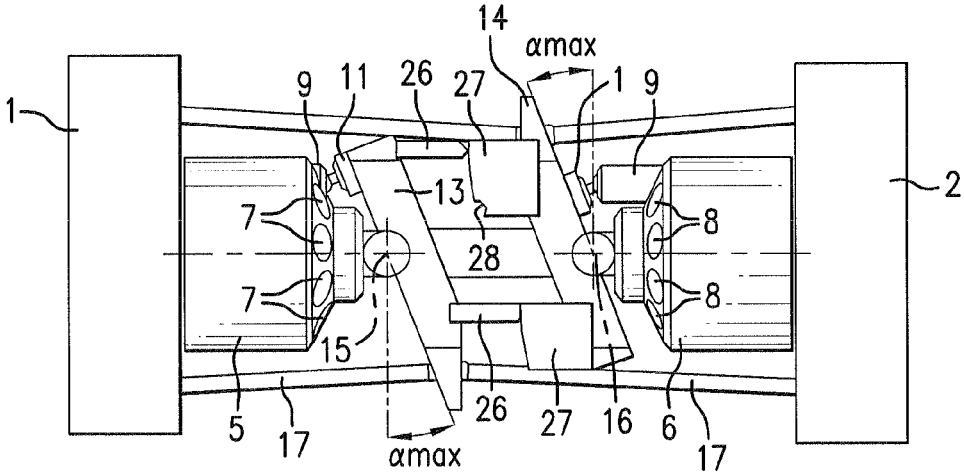
FIG. 2 is a view from the side of a second embodiment of hydrostatic machine according to the invention, showing the swash plates set to their maximum inclination.

FIG. 2 is a view from the side of a second embodiment of hydraulic machine according to the invention. Once again, the outer shell connecting the end-walls 1, 2 has been omitted to enable the inside of the machine to be shown. The plurality of cylinder bores 7, 8 of each axial-piston unit can be seen in this case. Of the pistons 9 with which these bores 7, 8 are fitted, only one has been shown in each of the axial-piston units 5, 6.

The swash plate 13 carries two supports 26 in bar or ridge form whose tips rest against contact blocks 27 on the swash plate 14 in such a way as to be able to move by sliding. The supports 26 and contact blocks 27 transmit the forces which are exerted by the pistons 9 of one of the axial-piston units 5, 6 on the swash plate 13 or 14 situated opposite the said pistons to whichever is the other swash plate 14 or 13 in the given case, and the pressures from the axial-piston units thus compensate for one another and do not have to be absorbed by the mountings of the axes of pivot 15, 16 on the housing or by the rods 17.

Figure 3:
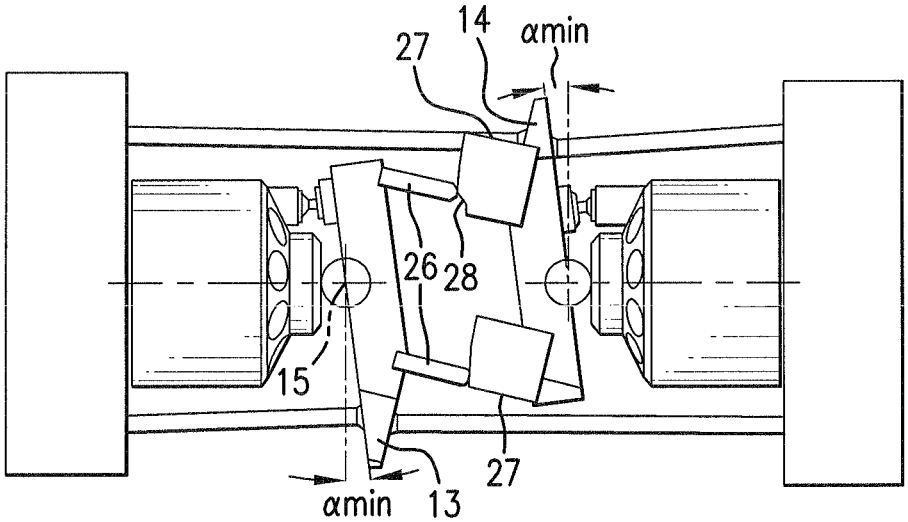
FIG. 3 is a view from the side similar to FIG. 2 which shows the swash plates coupled at a minimum angle of pivot.

The tips of the supports 26 are able to move by sliding across the contact blocks 27 and remain in contact with them if the swash plates 13 are pivoted from the most pronounced inclined position possible $\alpha_{max}$ which is shown in FIG. 2, or in other words the position corresponding to the largest possible indrawn volume for the axial-piston units 5, 6, to the position which is shown in FIG. 3. In the position shown in FIG. 3, the inclined position of the swash plates 13, 14 is only $\alpha_{min}$, and the tip of the upper support 26 is situated directly against the boundary of an arcuate flank 28 of the upper contact block 27, which arcuate flank 28 is centred on the axis of pivot 15.

Figure 4:
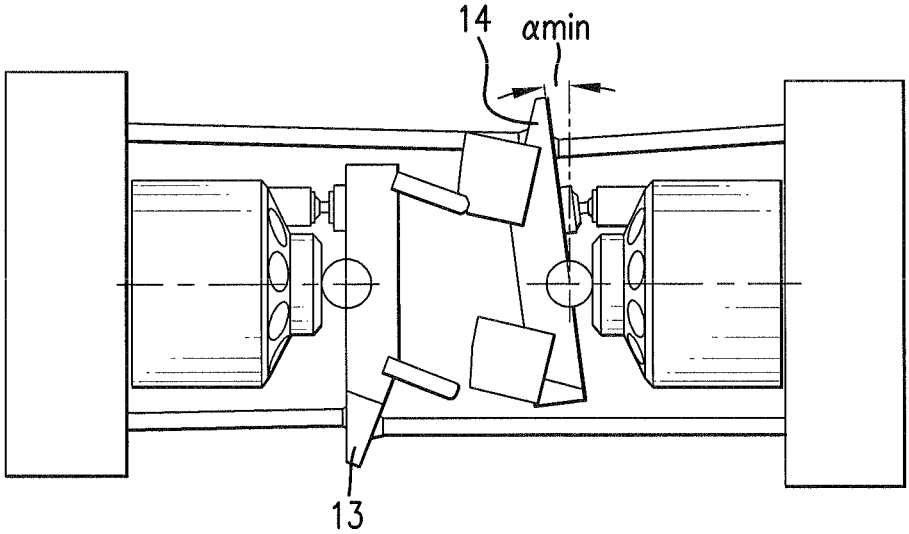
FIG. 4 is a view similar to FIG. 2 showing the swash plates decoupled.

If the swash plate 13 continues to be pivoted towards the zero position from the position shown in FIG. 3, the tip of the support 26 travels over the flank 28. Because the latter is arcuate and has the axis of pivot 15 as its centre, the swash plate 14 ceases to be entrained if the swash plate 13 continues to pivot towards the zero position. FIG. 4 shows the final result of such an adjustment: the swash plate 13 has reached the zero position whereas the swash plate 14 has remained in the orientation shown in FIG. 3, at the angle of pivot $\alpha_{min}$.

As can easily be seen, in the two embodiments considered above the distance between the surfaces of the two swash plates 13, 14 with which the sliding shoes 11 are in contact is equal to the distance between the axes of pivot 15, 16 and is independent of the orientation of the swash plates, because the axes of pivot 15, 16 extend across the surfaces of the swash plates 13, 14 which are facing the pistons 9 and intersect the longitudinal axis 12 as they do so. Hence, the total volume of fluid in the cylinder bores 7, 8 of the two axial-piston units 5, 6 is not dependent on the orientation of the swash plates 13, 14 and losses attributable to the compressibility, though small, of the hydraulic fluid circulating in the cylinder bores 7, 8 are not dependent on the orientation of the swash plates 13, 14. In contrast to this, the distance as measured along the longitudinal axis between the surfaces of the single swash plate in DE 10 2007 022 022 A1 is smallest when the swash plate is in its neutral position. Losses attributable to the compressibility of the hydraulic fluid are therefore particularly high close to the neutral position in the conventional hydrostatic machine. The swash plates 13, 14 according to the invention, which are separate from one another but coupled, enable this disadvantage to be avoided.

Figure 5:
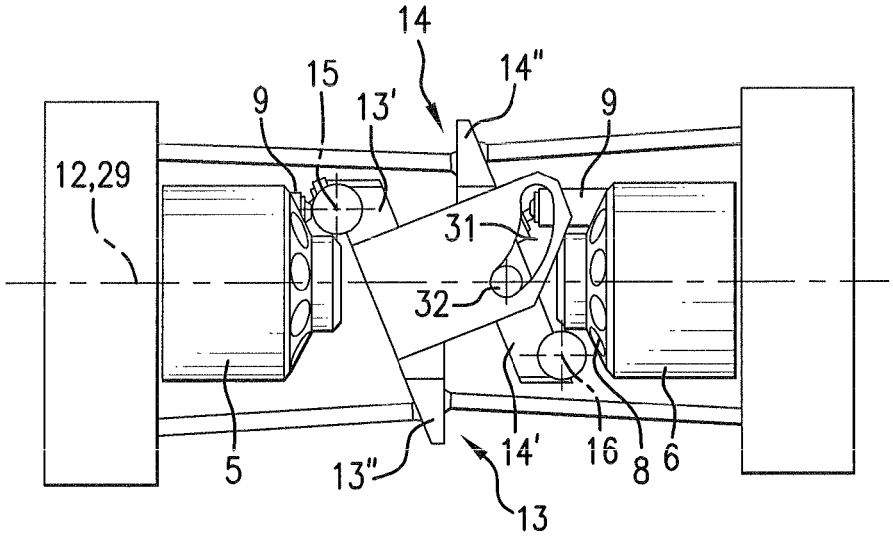
FIG. 5 is a view from the side of a third embodiment of hydraulic machine according to the invention.

FIG. 5 is a view, similar to FIG. 2, of a third embodiment of hydrostatic machine according to the invention. The housing of the machine and the axial-piston units 5, 6 are the same as in the embodiments considered above and will not be described again. A plane 29 which is perpendicular to the plane of the drawing and which extends along the longitudinal axis 12 divides each of the two swash plates 13, 14 into two halves, namely respective halves 13' and 14' adjacent the associated axial-piston units 5 and 6 respectively, and respective halves 13" and 14" remote from the axial-piston units 5 and 6 respectively. The axes of pivot 15, 16 are offset from the said plane 29 in parallel positions and are respectively situated on the same sides of the plane 29 as those halves 13' and 14' of the swash plates which are adjacent the axial-piston units. The axes of pivot 15, 16 intersect the longitudinal axes of respective cylinder bores 7 and 8 whose piston 9 (not shown in the case of the axial-piston unit 6) is at its top dead centre. At this top dead centre, the volume of the cylinder concerned is virtually zero, and does not change as a function of the orientation of the swash plate 13 or 14. Consequently, losses of efficiency caused by the compressibility of the hydraulic fluid are negligible in this embodiment.

Figure 6:
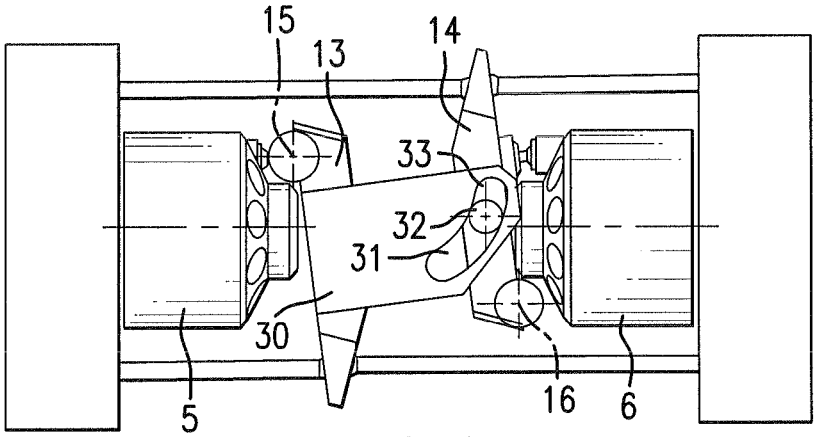
FIG. 6 is a view from the side similar to FIG. 5 which shows the swash plates coupled at a minimum angle of pivot.
Figure 7:
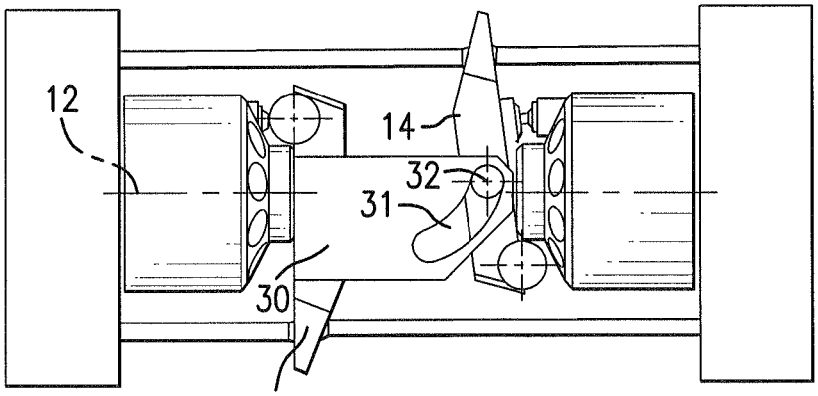
FIG. 7 is a view from the side which shows the swash plates in a decoupled state.

Arranged on the edges of the swash plate 13 are two plates 30, situated in opposite positions from one another, of which one conceals the other in each of the views shown in FIGS. 5 to 7. The plates 30 each have a slotted hole or guiding track 31. Engaging in the slotted holes or guiding tracks 31 are cylindrical projections or stops 32, which stops project from each of the sides of the swash plate 14. FIG. 5 shows the swash plates 13, 14 in a stop position at their maximum inclination, once again in a position inclined at $\alpha_{max}$, in which the cylindrical projection/stop 32 is at one end of the slotted hole/guiding track 31. Starting from this end, the shape of the slotted hole//guiding track 31 is initially dictated by the requirement that the two swash plates 13, 14 are always to pivot in parallel with one another.

FIG. 6 shows the swash plates 13, 14 at the smallest possible inclined position $\alpha_{min}$ which the swash plate 14 is able to reach. As can be seen, the cylindrical projection/stop 32 has not yet reached the opposite end of the slotted hole/guiding track 31 in this position. The portion 33 of the slotted hole/guiding track 31, which portion 33 extends from the position shown in FIG. 6 for the cylindrical projection/stop 32 to the opposite end of the slotted hole/guiding track 32, is an arc of a circle whose centre coincides with the axis of pivot 15. Consequently, the swash plate 14 no longer follows a pivoting movement by the swash plate 13 if the latter moves towards the zero position beyond the position shown in FIG. 6. This produces the configuration shown in FIG. 7 where the swash plate 13 is in the zero position orthogonal to the longitudinal axis 12 whereas the swash plate 14 is still in the inclined position $\alpha_{min}$.

It will be understood that each of the elements described above, or two or more together, may also find a useful application in other types of constructions differing from the types described above.

While the invention has been illustrated and described as embodied in a hydrostatic machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention. What is claimed as new and desired to be protected by Letters Patent is set forth in the appended claims.

The invention claimed is:

1. A hydrostatic machine, comprising:

first and second adjustable swash plates arranged opposite one another, where each of the first and second swash plates is configured with a front surface and an opposing back surface, wherein the front surfaces of the opposing swash plates face each other;

first and second axial-piston units arranged on a common axis and having pistons, wherein the pistons of said first axial-piston unit operate to cause a pressing force to be applied against the back surface of said first adjustable swash plate, which is associated with said first axial-piston unit and wherein the pistons of said second axial-piston unit operate to cause a pressing force to be applied against the back surface of said second swash plate, which is associated with said second axial-piston unit; and a coupling mechanism which couples said first and said second swash plates mechanically and adjustably;

wherein said first and said second axial-piston units are positioned relative the back surfaces of said first and second swash plates, respectively.

2. A hydrostatic machine as defined in claim 1, wherein said first and second axial-piston units are connected together in such a way as to be solid in a rotation with one another.

3. A hydrostatic machine as defined in claim 1, wherein said first and second swash plates are pivotable on a mutually parallel axes and are held parallel to one another by said coupling mechanism.

4. A hydrostatic machine as defined in claim 3, wherein at least an axis of a pivot of said first swash plate is offset from a common longitudinal axis of said first and second axial-piston units, and a distance between said first and second swash plates in an axial direction is all the greater the less inclined is their position.

5. A hydrostatic machine as defined in claim 1, wherein a plane extending along a common axes of said first and second axial-piston units divides at least said first swash plate into a half adjacent to said first axial-piston unit and a half remote from said first axial-piston unit, and an axis of pivot of said first swash plate is situated on a same side of said plane as said half which is adjacent to said first axial-piston unit.

6. A hydrostatic machine as defined in claim 5, wherein the axis of said pivot of said first swash plate extends across the back surface of said first swash plate, which faces said first axial-piston unit.

7. A hydrostatic machine as defined in claim 6, wherein a longitudinal axis of a cylinder of said first axial-piston unit which is situated at a top dead center intersects an axes of a pivot of said first swash plate.

8. A hydrostatic machine as defined in claim 1, wherein said coupling mechanism has a support which extends between said first and said second swash plates and which is arranged to pass on force exerted by one of said first and second axial-piston units on said one unit's associated swash plate to the other of said swash plates.

9. A hydrostatic machine as defined in claim 1, wherein said coupling mechanism has a guiding track solid with one of the first and second swash plates and a stop which is solid with another of said first and second swash plates and wherein the stop is positioned within and slidingly movable along said guiding track.

10. A hydrostatic machine as defined in claim 9, wherein said guiding track has an arcuate portion comprising an arc length of a virtual circle which is centered on an axis of pivot of said one of the first and second swash plates.

11. A hydrostatic machine as defined in claim 1, wherein said coupling mechanism has an element selected from the group consisting of a gearing and an articulated linkage.

12. A hydrostatic machine as defined in claim 1, wherein one of said first and second swash plates has a greater freedom of pivoting movement than another of said first and second swash plates, and wherein said freedom of pivoting movement of said one of said first and second swash plates includes a zero position.

13. A hydrostatic machine, comprising:

a cylindrical housing including first and second endwalls;

first and second adjustable swash plates arranged opposite one another, where each of the first and second swash plates is configured with a front surface and an opposing back surface, wherein the front surfaces of the opposing swash plates face each other;

first and second axial-piston units including pistons, arranged on a common axis, and positioned relative the back surfaces of said first and second swash plates, respectively, wherein the pistons of said first axial-piston unit operate to cause a pressing force to be applied against the back surface of said first adjustable swash plate, which is associated with said first axial-piston unit and wherein the pistons of said second axial-piston unit operate to cause a pressing force to be applied against the back surface of said second swash plate, which is associated with said second axial-piston unit; and a coupling mechanism which couples said first and said second swash plates mechanically and adjustably, where said coupling mechanism comprises endwall pistons displaceably positioned in the first and second cylinders within each of the first and second endwalls of the cylindrical housing, wherein rods connected at first rod ends to the displaceable endwall pistons have second rod ends that engage respective opposite edges of said first and second swash plates such that displacing the displaceable endwall pistons pivots the swash plates about said first and second swashplate mutually parallel axes of pivot.

* * * * *